United States Patent [19]

Bohrer et al.

[11] Patent Number: 4,678,882

[45] **Date of Patent: * Jul. 7, 1987**

[54] PACKAGING CONTAINER FOR MICROWAVE POPCORN POPPING

[75] Inventors: Timothy H. Bohrer; Thomas D. Pawlowski, both of Neenah; Richard K. Brown, Appleton, all of Wis.

[73] Assignee: James River-Norwalk, Norwalk, Conn.

[ * ] Notice: The portion of the term of this patent subsequent to Nov. 12, 2002 has been disclaimed.

[21] Appl. No.: 815,318

[22] Filed: Jan. 3, 1986

Related U.S. Application Data

[60] Continuation of Ser. No. 735,576, May 20, 1985, abandoned, which is a division of Ser. No. 510,735, Jul. 5, 1983, Pat. No. 4,553,010.

[51] Int. Cl.[4] ..... H05B 6/80

[52] U.S. Cl. ..... 219/10.55 E; 219/10.55 F; 219/10.55 M; 99/323.4; 99/DIG. 14; 426/107; 426/243

[58] Field of Search ..... 219/10.55 E, 10.55 F, 219/10.55 M; 426/107, 106, 111, 115, 113, 241, 243, 234; 99/DIG. 14, 323.4, 323.5

[56] References Cited

U.S. PATENT DOCUMENTS

| | | | |
|---|---|---|---|
| 3,671,270 | 6/1972 | Jehn | 426/111 |
| 3,835,280 | 9/1974 | Gades et al. | 219/10.55 E |
| 3,973,045 | 8/1976 | Brandberg et al. | 426/111 X |
| 4,038,425 | 7/1977 | Brandberg et al. | 426/107 |
| 4,156,806 | 5/1979 | Teich et al. | 219/10.55 E |
| 4,190,757 | 2/1980 | Turpin et al. | 219/10.55 E |
| 4,219,573 | 8/1980 | Borek | 426/107 |
| 4,267,420 | 5/1981 | Brastad | 219/10.55 F X |
| 4,277,506 | 7/1981 | Austin | 426/111 |
| 4,279,933 | 7/1981 | Austin et al. | 426/113 X |
| 4,292,332 | 9/1981 | McHam | 426/111 |
| 4,553,010 | 11/1985 | Bohrer et al. | 219/10.55 E |

FOREIGN PATENT DOCUMENTS 2046060 5/1983 United Kingdom .

*Primary Examiner*—Philip H. Leung
*Attorney, Agent, or Firm*—Sixbey, Friedman & Leedom

[57] ABSTRACT

A container (2) for heating popcorn or other types of particulate food items in a microwave oven formed from a single blank having a bottom panel (4) coated with a microwave interactive material (26) adding heat to particulate food items such as popcorn kernels and configured so that each particulate food item placed into the container (2) for heating is spaced, on average, no more than the average diameter of one such food item away from the microwave interactive layer. The container is formed for shipping in a triangular wedge shape and for expansion to a trapezoidal box shape for use within a microwave oven for heating of the particulate food items.

11 Claims, 6 Drawing Figures

PACKAGING CONTAINER FOR MICROWAVE POPCORN POPPING

This application is a continuation of application Ser. No. 735,576, filed 5/20/85 now abandoned which is a divisional of application Ser. No. 510,735, filed July 5, 1983, now U.S. Pat. No. 4,553,010.

TECHNICAL FIELD

This invention relates to a packaging container for cooking particulate food items such as popcorn in a microwave oven, to a method for using such a container, and, in particular, to an expandable disposable paperboard container suitable for packaging particulate food items when collapsed and for facilitating microwave heating of the food items when expanded.

BACKGROUND ART

The development of microwave cooking has had an enormous impact on commercial, industrial and home food preparation. The high speed with which cooking occurs and the broad array of materials suitable for use in microwave ovens have engendered a large number of new uses for microwave ovens. One such use is the popping of kernels of corn. Due to the violent movement of popcorn during the popping process and to the expanded volume of space occupied by the popped corn, an enclosed container for the corn kernels and cooking oil, if used, is indispensible. However, use of this kind of container requires difficult choices among sometimes conflicting performance goals.

One such choice is presented by the alternative materials available to construct the container. A container formed of rigid material, such as microwave transmissive plastic as illustrated in U.S. Pat. No. 4,156,806 to Teich et al, has the advantage of being suitable for reuse but is totally unsatisfactory as a popcorn shipping and dispensing container due to its susceptibility to breakage, its substantial volume and its relatively high cost of manufacture. A container constructed from a disposable material such as paper overcomes many of the disadvantages of rigid reusable containers, but raises questions concerning efficiency and adequate heat dispersal. An early attempt to produce a satisfactory paperboard container is illustrated in U.S. Pat. No. 3,973,045 to Brandberg et al. The container of this patent is a compact qussetted bag made from two plys of paper and has a flexible body which expands to accommodate the increased volume of popped popcorn. While the Brandberg container functions desirably for its intended purpose, it still leaves up to 25 percent of the corn kernels unpopped and 5 percent burned after exposure for approximately two and one half minutes to microwave energy. Other types of expandable paperboard cartons suitable for popping popcorn in a microwave oven are disclosed in U.S. Pat. Nos. 4,279,933 to Astin et al and 4,260,101 to Webinger.

A variety of patents disclose other efforts to remedy the various deficiencies of known containers for the popping of kernels of corn in a microwave oven. For example, a number of solutions involving more efficient use of heat have been proposed to reduce the percentage of corn kernels left unpopped. Some improvement was derived by increasing the heat applied to unpopped corn kernels through use of a dual compartment container, as disclosed in the patent to Brandberg et al (U.S. Pat. No. 4,038,425). The container of this patent has a large upper compartment with inclined walls slanting towards a second lower compartment containing hot melted fat. Unpopped corn kernels are caused to fall back under the force of gravity into the heated lower compartment by sliding or rolling down the walls of the upper compartment.

The patents of Teich et al (U.S. Pat. No. 4,156,806, discussed above,) and to Ishino et al (U.S. Pat. No. 4,335,291) disclose a different approach to improving the efficiency of a popcorn container. In particular, the containers disclosed in these patents rely primarily on concentrating microwave energy at the base of a conically shaped bowl where corn kernels are clumped for the alleged purpose of improving the efficiency and speed of popping. One embodiment disclosed in the Teich et al patent uses a microwave lossy powdered or particulate material in the base area. The lossy material itself heats up and radiates that heat to the kernels located close to it, thereby adding to the heat induced in the corn kernels by direct impingement of the microwaves on the kernels. However, clumping corn kernels in one area of a popping container causes some of the kernels to rest substantially away from the heat generated by the lossy material and, thus, to pop more slowly and less efficiently since they receive a minimal amount of additional heat from the microwave lossy material in the popping container.

As disclosed in the patents to Winters et al (U.S. Pat. No. 4,283,427), Brastad et al (U.S. Pat. No. 4,230,924), Turpin et al (U.S. Pat. No. 4,190,757), Tanizaki (U.S. Pat. No. 3,783,220), Fichtner (U.S. Pat. No. 3,302,632) and Copson et al (U.S. Pat. No. 2,830,162), the use of microwave lossy material is a widely known concept in microwave food preparation containers. However, none of these patents disclose how to employ such lossy material to improve microwave popping of popcorn.

In yet another approach designed to achieve improved microwave popping of popcorn, the patent to Borek (U.S. Pat. No. 4,219,573) discloses a container which is designed to increase the heat available for popping by preventing heat loss in the package through inclusion of a pad designed for heat retention. Again, marginal improvement was noted, but, since the pad is not designed to be interactive with microwaves, it does not itself supply additional heat for application to the corn kernels within the package.

All of the above patents, although making significant contributions to the field of shipping and dispensing kernels for popping in a microwave oven, still leave an undesirably large number of kernels of corn either unpopped or burned. Thus, it has remained an elusive goal in the microwave popcorn popping container art to produce an inexpensive container which strikes a proper functional balance between low cost and efficacy.

DISCLOSURE OF THE INVENTION

It is the primary object of the subject invention to overcome the deficiencies of the prior art by providing a packaging container for use in heating particulate food items, such as popcorn, in a microwave oven, which is inexpensive to manufacture, maximizes the number of food items properly heated and minimizes scorching and burning of such food items during the heating process.

Another object of this invention is to avoid clumping of particulate food items, such as kernels of corn, and promote scattering of these items across a microwave interactive heating surface by use of a flat, horizontal food item supporting surface in the container to provide an ideal spacial relationship for the placement of kernels within a popcorn popping container and an ideal division of microwave energy between that converted to heat and that being absorbed directly by the corn kernels to optimize the popping process.

Still another object of this invention is to provide a container for heating a predetermined number of particulate food items having a bottom panel coated with a microwave interactive layer, the size of which panel is determined relative to the number of particulate food items to be heated so that no food item is, on average, more than one average item's diameter away from the microwave interactive layer.

Yet another object of this invention is to provide a container which can be manufactured from a single unitary blank wherein the container has a pair of collapsible side wall panels which permit the top portion of each side wall panel to be either collapsed, so that the container can assume a triangular vertical cross section configuration for shipping, or expanded, so that the container will assume a larger volume cross sectional configuration for use in a microwave oven.

The top wall panel of the container may be removably secured to its front wall panel in order to close the container prior to shipping and may have a closing flap connected thereto containing an apertured slit therein into which fits a key-shaped tab included in the front wall panel of the container so as to close the top wall panel prior to exposure of the container to microwaves.

Yet an additional object of this invention is to provide a container for use in popping a premeasured quantity of unpopped popcorn kernels having a known average diameter and a predictable total volume when popped in a microwave oven which container may serve in a reduced volume configuration both as a shipping and vending package and, in an expanded volume configuration, as a package for heating the premeasured popcorn and a premeasured quantity of oil in a microwave oven.

It is a further object of this invention to provide a method for heating microwave expandable, particulate food items having a known average diameter within a container having a bottom panel covered with a microwave interactive layer of known relative dimensions for converting microwaves into heat.

Other and more specific objects of the invention may be understood from the followig Brief Description of the Drawings and Best Mode for Carrying Out the Invention.

BEST MODE FOR CARRYING OUT THE INVENTION

Figure 1:
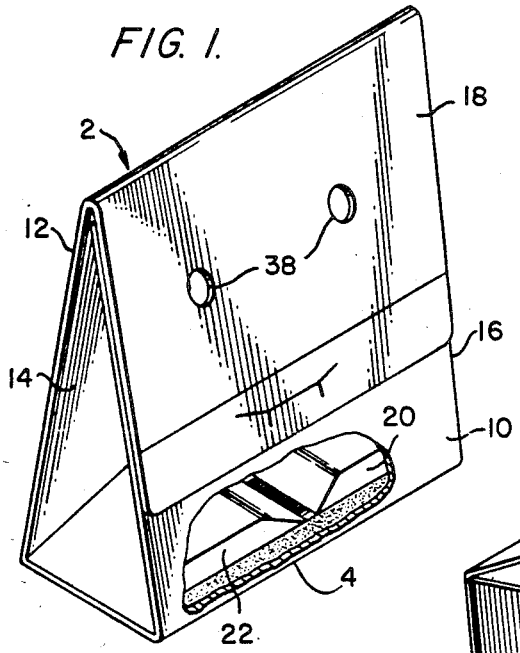
FIG. 1 is a cut away, isometric perspective view of a microwave container designed in accordance with this invention wherein the container is illustrated in its reduced volume configuration suitable for shipment.

For a clear understanding of the subject invention, reference is initially made to FIG. 1 in which an expandable microwave packaging container 2 suitable for shipping and designed in accordance with the subject invention is illustrated. This container is initially formed from a single paperboard blank, as described below, into a triangular wedge-shaped form in order to facilitate shipping by providing both a container which is structurally strong, as well as one which occupies a minimal amount of physical space so as to maximize the number of such containers that fit into a given area, thereby reducing shipping costs. As illustrated in FIG. 1, the packaging container 2 of this invention includes a bottom wall panel 4, generally planar front wall panel 10, back wall panel 12 (only the edge of which is illustrated in FIG. 1, a top wall panel 18 and a pair of side walls panels 14 and 16. Only the edge of side wall panel 16 appears in FIG. 1. The side wall panels 14 and 16 are creased to allow the top edges of the back and front wall panels 10 and 12 to be brought together to form the triangular configuration. A top wall panel foldably connected to the top edge of the back wall panel is brought into face to face contact with front wall panel 10 and is removably attached to front wall panel 10 to maintain the compact triangular configuration illutrated in FIG. 1 when the container is being shipped. As further illustrated in the cut away portion of FIG. 1, container 2 may be used to store a packet of corn kernels 20 and a separate package of cooking oil 22 for shipment within the container 2. Alternatively, the corn and oil may be packaged together. The container may also include salt or other flavorings in premeasured quantities. The unique features of container 2 will be better understood by a consideration of the following explanation of its elements and assembly.

Figure 2:
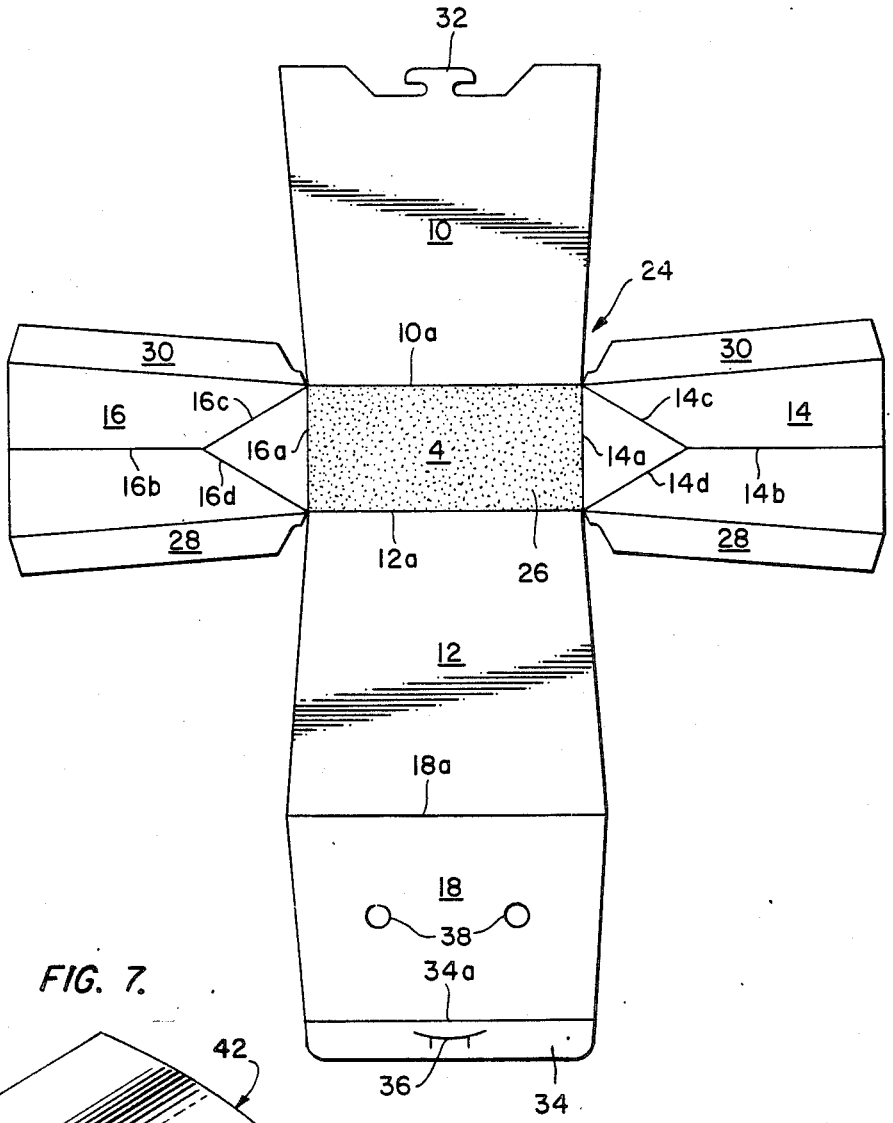
FIG. 2 is a top plan view of the paperboard blank from which the container of FIG. 1 is formed.

The container 2 is formed from a single unitary paperboard blank 24, a top plan view of which is shown in FIG. 2. Paperboard has a number of desirable characteristics which makes it ideally suited as the primary structural component of a disposable microwave food item container. In particular, paperboard is strong, microwave transparent, easily adapted to receive advertising display graphics and easily handled during container assembly. All of these advantages combine with its recyclability and biodegradability to make paperboard an ideal material for purposes of this invention. Blank 24 includes basically six interconnected panels referred to above as bottom wall panel 4, front wall panel 10, back wall panel 12, side wall panels 14 and 16, and top wall panel 18. Together, the front, back, and side wall panels form a perimeter wall surrounding the interior of the container. This perimeter wall can be considered an outer carton means for containing the unpopped kernels. The bottom wall panel 4 may be considered a food item support means for supporting food items within the outer carbon means. To further improve the suitability of paperboard as the basic structural component of the disclosed container, a grease resistant layer may be laminated on either or both sides of the paperboard material from which the container blank is formed.

Figure 5:
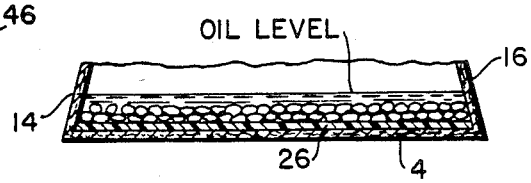
FIG. 5 is a fragmentary cross sectional view of the container of FIG. 4 showing the optimal arrangement of food items on the bottom of the container prior to heating.

The bottom wall panel 4 is generally flat and rectangular and is laminated during the blank forming process with a microwave converting means including a layer of microwave interactive material 26, as indicated by the stippled area in FIG. 2 and as shown in FIG. 5. This interactive material is microwave "lossy" which means that it absorbs a portion of the microwave energy impinging thereon so that its surface temperature rises. Both the physical configuration and the microwave interactive nature of this panel are crucial, as discussed below, to the inventive qualities disclosed herein. Examples of suitable microwave interactive materials are disclosed in U.S. Pat. No. 4,190,757 to Turpin et al. Moreover, this material may take the form of a metalized layer of polyethylene terephthalate or other types of microwave interactive material as disclosed in U.S. Pat. Nos. 3,783,220 to Tanizaki; 4,230,924 to Brastad et al or 4,283,427 to Winters et al. Two identical, opposed side wall panels 14 and 16 are foldably connected along fold lines 14*a* and 16*a*, respectively, to bottom wall panel 4. Each side wall panel has two sealing flaps 28 and 30 which are foldably connected thereto and which are attached in some suitable manner, such as by adhesive, to front wall panel 10 and back wall panel 12, respectively, when the container is assembled, in order to add to the structural strength of the package and to minimize the amount of liquid, such as cooking oil, which could otherwise tend to seep from the package. Should an objectionable amount of oil leak from the container, the container 2 may be internally sealed to provide a leakproof package. Each side wall panel contains a pattern of fold lines to allow the side wall panels to be partially collapsed at the top during shipping to form the durable, compact triangular package illustrated in FIG. 1 and further permit the same side wall panels to be unfolded prior to use in a microwave oven to expand the volume of the container during the heating process.

Front wall panel 10 of blank 24 is also foldably connected to bottom panel 4 along foldline 10*a* and contains key-shaped closing tab 32 with which the container is closed prior to exposure to microwaves. Back wall panel 12 is foldably connected to bottom panel 4 along foldline 12*a*. This arrangement provides the dual package configuration flexibility discussed above by permitting top wall panel 18 (attached to back wall panel 12 along foldline 18*a*) to be used as a sealing panel attached to the exterior of front wall panel 10 when the container is prepared for shipping, while also making it usable as a closeable top wall panel when the container is inserted in a microwave oven. A closing flap 34 is attached along fold line 34*a* to top wall panel 18 and contains aperture slit 36 cut through the paperboard which is large enough to permit key-shaped closing tabe 32, formed as part of front wall panel 10, to pass through and lock closing flap 34. Top wall panel 18 has another significant feature. Two ventilation apertures 38 formed in this panel allow gases released when an expandable food item such as popcorn is heated in the container to escape so that the container itself will not fracture or be damaged and the gases will not interfere in any other way with completion of the heating process.

The use of a single unitary blank design as illustrated in FIG. 2 significantly reduces the complexity of forming the container as will now be demonstrated by reference to FIGS. 1, 2, 3 and 4 which show the container in various stages of assembly. To form a packaging container from the blank illustrated in FIG. 2, the front, back and side wall panels are folded along their respective foldlines into a position which allows sealing flaps 28 to be secured to the inside surface of back wall panel 12 and which allows sealing flaps 30 to be secured to the inside surface of front wall panel 10.

As is evident from examination of FIG. 2, the side, back and front wall panels are each tapered outwardly toward the top in a generally trapezoidal shape so that container 2 assumes a generally wide mouthed, open top configuration when assembled. This shape is important for two reasons. First, it allows easier removal of popped corn from the container than would a strictly rectangular shape, and, second, it permits containers to be partially erected and nested within each other for economical shipping from the blank manufacturer to the point of packaging.

At the point of packaging, food items, such as illustrated in the cut away of FIG. 1 in the form of a packet of corn kernels 20 and a packet of cooking oil 22, are placed inside container 2. At this point, side wall panels 14 and 16 are partially collapsed towards the interior of the container along fold lines 14*b, c, d* and 16*b, c, d*, respectively, so that the top edges of side wall panels 14 and 16 become generally congruent with the top edges of the front and back wall panels 10 and 12. Then top wall panel 18 is folded down along fold line 18*a* until it contacts along its entire interior surface the exterior surface of front wall panel 10 so that it may be removably attached thereto to close the container. In this configuration, the container has the structurally strong form of a triangular wedge, enabling it to withstand the rigors of shipping and intermediate handling, yet it is also extremely compact, thereby occupying minimal storage, shipping and eventual vending display space. It is important to note that top wall panel 18 is tapered inwardly to conform to the lateral edges of the front wall panel 10 as illustrated in FIG. 1. This form prevents the top wall panel from overlapping the edges of front wall panel 10 after being closed at the point of packaging.

Figure 3:
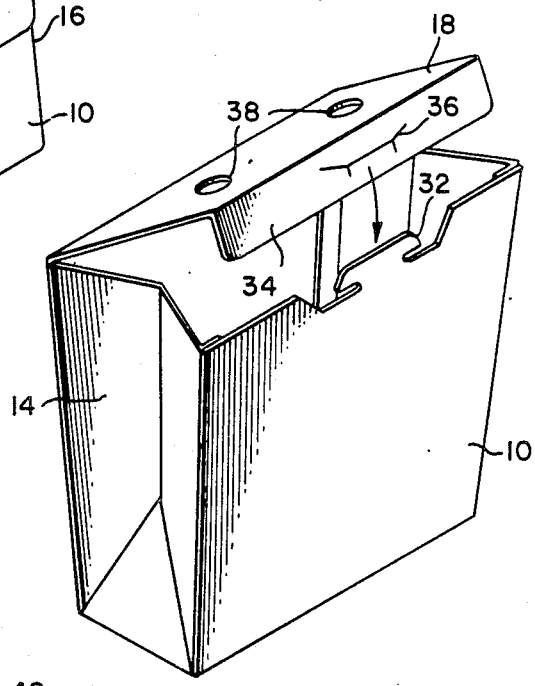
FIG. 3 is an isometric perspective view of the microwave container of FIG. 1 after it has been expanded for use in a microwave oven.
Figure 4:
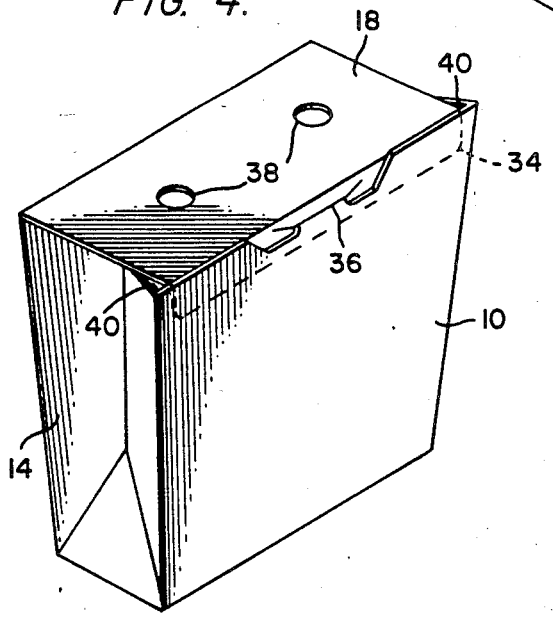
FIG. 4 is a perspective view of container of FIG. 3 wherein the top has been closed in preparation for insertion into an oven.

Before the container can be used in a microwave oven, however, it must be reconfigured. Reference is now made to FIGS. 3 and 4 to illustrate the ease with which this may be accomplished. By detaching top wall panel 18 from its shipping position (attached to the exterior surface of front wall panel 10), the top edges of the back and front panels are separated, aided by the resilience inherent in the paperboard of which the container is formed. Next, the user withdraws food packets 20 and 22 from the interior of the container, opens them and deposits their contents on the layer of microwave interactive layer material 26 covering bottom panel 4.

FIG. 5 shows a cross sectional view taken along a vertical plane midway between front wall panel 10 and back wall panel 12 of container 2 after packets 20 and 22 have been opened and their contents have been placed on the layer of the microwave interactive material 26 covering bottom wall 4.

In order to finish preparing container 2 for insertion into a microwave oven, closing flap 34 is folded down along line 34*a* and aperture slit 36 may be loosened, if necessary, manually or by means of a suitable device. Top wall panel 18 may then be closed by pushing closing flap 34 into the interior of container 2 against the interior surface of front wall panel 10 while inserting key-shaped closing tab 32 into the opening that was created by loosening aperture slit 36. Note that when the container is assembled in this manner, the upper edge of each side wall panel 14 and 16 is caused to assume an inwardly directed angular configuration. This angular configuration results from the fact that the total length of the upper edge of each side wall panel, 14 and 16, is greater than the perpendicular distance between the front and back edges of the top wall panel 18. Accordingly, upon closure of the top wall panel 18 (FIG. 4), the side wall panels 14 and 16 are retained in a partially collapsed state. Further, since top wall panel 18 is tapered inwardly, as discussed above, a pair of small openings, shown in FIG. 4 at 40, are left remaining at the front corners where top wall panel 18 contacts front wall panel 10. However, this space is calculated to be smaller than a popped kernel of corn so that no kernels will be ejected from the container during microwave heating. These design features permit the container to retain the advantages of a trapezoidal shape while still functioning properly. FIG. 4 demonstrates the appearance of a closed container ready for exposure to microwaves. Also shown in FIGS. 1, 3 and 4 are the two ventilation apertures 38 which allow gases and water vapor formed during the heating process to escape from container 2, as discussed earlier.

In order to serve the food within the container, the user simply opens top wall panel 18 by exerting opening force at aperture slit 36 so that key-shaped closing tab 32 will disengage from closing slit 36 and allow the top wall panel 18 to be opened. The heated food items within the container may then be consumed either directly from the container or may be served in any other desirable manner. In either event, the container is disposable after its use.

Although it is contemplated that the subject container will normally be vended with premeasured quantities of popcorn and oil contained therein, containers designed in accordance with this invention could also be sold empty. Such empty containers could be filled by the ultimate user with the desired amount of popcorn up to a limit which would be the same as the premeasured amount of popcorn which the area of the bottom wall panel and the volume of the container is designed to handle.

As explained earlier, two of the major problems with disposable microwave popcorn containers have been the relatively high percentage of kernels left unpopped after exposure to microwaves combined with the danger of simultaneously scorching an undesirably high percentage of kernels. By calculating the final volume which will be occupied by the premeasured quantity of food items which are to be placed in the container, the volume needed for container 2 in its expanded state can be determined. At this point, the design departs importantly from the prior art discussed above. It has been determined that if food items, such as corn kernels, are positioned on a microwave interactive layer formed in a generally flat, horizontal configuration to support the kernels in an unclumped and scattered manner so that no kernel is more than one average kernel's diameter from the heating surface, significantly fewer kernels are left either unpopped or burned than was possible with any of the containers disclosed in the prior art. This improvement results both from the physical configuration and from the fact that heat is added to the corn kernels by use of the microwave interactive layer.

Practical comparisons made between a container using this concept and clumping-type prior art containers confirm the superior performance of the invention of this disclosure. Using 180 kernels of a development grade of popcorn and 10 grams of oil, tests were conducted using three different container including Type 1, a popping appliance designed in accordance with the patent to Teich (U.S. Pat. No. 4,156,806); Type 2, a modified version of the Teich appliance in which a separate interactive layer was added where corn kernels are clumped at the base of the appliance to simulate the effect of the interactive microwave layer used in the present invention; and Type 3, a device as disclosed herein, with the following results:

| | No. of Unpopped Kernels | % Unpopped |
|---|---|---|
| Type 1 | 30–36 | 16–20 |
| Type 2 | 25–32 | 13–17 |
| Type 3 | 3–7 | 1–3 |

In another test using a Teich-type container, type 1, and a container designed in accordance with the subject invention, type 3, the following results were observed:

| | % Unpopped | Average Volume of Popped Kernels (ml/Kernel) | Volume Per Gram of Corn |
|---|---|---|---|
| Type 1 | 21.4 | 3.6 | 21.1 |
| Type 3 | 12.5 | 4.1 | 26.0 |
| % Diff. | −42% | +14% | +23% |

These results demonstrate the superiority of the subject design at least under the operating conditions described above.

Figure 6:
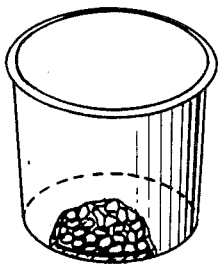
FIG. 6 is a perspective view of another embodiment of the subject invention.
Figure 7:
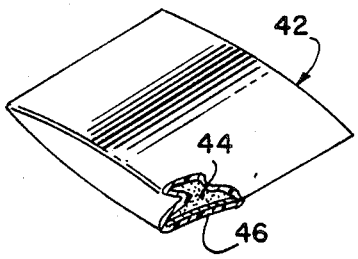
FIG. 7 is a cut-away perspective view of a gussetted bag designed in accordance with the subject invention.

The expandable packaging container disclosed herein is not limited by the configuration described above. It may also take the form of a paperboard cup with the microwave lossy element added to the bottom of the cup either as a separate disk, or as a laminate and with a lid having apertures for releasing moisture produced during popping. See for example FIG. 6. In another embodiment, the container could be either a standard flat bottom paper bag in which the microwave lossy element is placed in the bottom of the bag or a gussetted pouch style bag, such as illustrated in FIG. 7 as bag 42 having the susceptor 44 spot-glued to a side 46. Holes in the bag or permeable paper would provide venting. In still another embodiment, the container could be made from standard glued or telescoping paperboard shell paperboard cartons with the microwave element in the bottom of the carton. A further embodiment could use a paperboard tray with folded material sealed to the top of the tray and having apertures in the tray to provide venting. Still other embodiments are possible.

Industrial Applicability

The container and method of this invention has particular application in the packaging, shipping, vending, microwave heating and serving of premeasured quantities of popcorn. One specific application involves the sale of the disclosed container through dispensing or vending machines located in commercial establishments. A larger size container could be sold for use in the home.

We claim:

1. A package for shipping and microwave popping of popcorn, comprising:

(a) a predetermined quantity of popcorn kernels which will occupy a predictable volume when popped;

(b) a package containing said predetermined quantity of popcorn and, when used for popping corn, having a predetermined internal volume at least equal to said predictable volume occupied by said popcorn kernels when popped, said package having a wall adapted to rest in a generally flat horizontal configuration upon a horizontal support surface in a microwave oven, said wall having an interior surface that is large enough for said predetermined quantity of unpopped popcorn to be spread thereon in a generally unclumped manner; and (c) a microwave converting means integrally connected with said package for converting microwave energy into heat for transfer in a sufficient amount to the popcorn kernels when unclumped to reduce substantially the number of burned or unpopped kernels that could result if the kernels were popped solely by direct impingement of microwave energy, said microwave converting means including a microwave interactive material whose temperature increases in response to impinging microwaves, said microwave interactive material being connected with said wall and co-extensive with an area of said interior surface which is sufficiently large to permit said predetermined quantity of popcorn to be spread thereon in said unclumped manner.

2. A package as defined in claim 1, wherein said package including said flat wall is formed of microwave transmissive material and said microwave interactive material is in the form of a layer which is mounted on and co-extensive with said flat wall.

3. A package as defined in claim 2, wherein said microwave interactive material includes a layer of metalized plastic.

4. A package as defined in claim 1, wherein said package is in the form of a cup and said wall is the bottom of said cup.

5. A method for microwave heating of a predetermined quantity of popcorn kernels which will occupy a predictable volume when popped within a container having an internal volume at least equal to said predictable volume of the popcorn kernels, a wall adapted to rest in a generally flat horizontal configuration upon a horizontal support surface in a microwave oven, and a microwave energy converting means integrally connected to said wall for converting microwave energy into heat comprising the steps of:

(a) placing oil onto the microwave converting means;

(b) placing said predetermined quantity of popcorn kernels within said container;

(c) arranging said container, in a closed condition, so as to have said wall resting upon a horizontal support surface of a microwave oven and said popcorn kernels spread upon said wall in a generally unclumped and scattered manner in heat transfer relationship with respect to said microwave energy converting means; and (d) exposing said container to microwave energy in a manner causing said popcorn kernels to be popped in response to direct impingement of microwave energy thereon and by heat transferred to the kernels by said microwave energy converting means.

6. A method according to claim 5, wherein each of said popcorn kernels is generally spaced an average kernel's diameter away or less from said microwave energy converting means.

7. A package for shipping and microwave popping of popcorn, comprising:

(a) a predetermined quantity of popcorn kernels which will occupy a predictable volume when popped;

(b) an expansible package having a collapsed first configuration defining an internal volume that is less than said predictable volume in which said predetermined quantity of popcorn is disposed in compactly packaged form for shipping and storage, said package being expandable from said first configuration into a second configuration wherein said internal volume is at least as great as said predictable volume for accommodating said popcorn kernels when popped; wherein said package enables redistribution of said popcorn kernels from the compactly packaged form for shipping and storage into generally unclumped and scattered popping distribution, said package having, for that purpose, a wall with an interior surface that is large enough for said predetermined quantity of unpopped popcorn to be spread thereon in said generally unclumped and scattered manner, said wall being adapted to rest in a generally horizontal configuration upon a horizontal support surface in a microwave oven; and (c) a microwave converting means integrally connected with said package for converting microwave energy into heat for transfer in a sufficient amount to the popcorn kernels when scattered and unclumped to reduce substantially the number of burned or unpopped kernels that could result if the kernels were popped solely by direct impingement of microwave energy, said microwave converting means including a microwave interactive material whose temperature increases in response to impinging microwaves, said microwave interactive material being connected with said flat wall and co-extensive with an area of said interior surface which is sufficiently large to permit said predetermined quantity of popcorn kernels to be spread thereon in said unclumped and scattered manner.

8. A package according to claim 7, wherein said package comprises a gusseted bag formed of paper and wherein said generally flat wall is a side wall of said bag.

9. A method for shipping and microwave popping of a predetermined quantity of popcorn kernels which will occupy a predictable volume when popped within an expansible package having an expanded configuration defining an internal volume that is at least as great as said predictable volume comprising the steps of:

(a) disposing said predetermined quantity of popcorn kernels in compactly packaged form in said package and shipping and storing said package in a collapsed configuration defining an internal volume that is less than said predictable volume;

(b) arranging said package, in a closed condition, so as to have a wall of said package that has a microwave energy converting means for converting microwave energy into heat connected thereto, in generally flat horizontal configuration upon a horizontal support surface of a microwave oven; and (c) popping said popcorn kernels within said closed packaged by directly exposing them to microwave energy produced by said microwave oven and to heat transferred to the kernals by said microwave energy converting means, said unpopped popcorn kernels being spread upon said wall in a generally unclamped and scattered manner upon said package wall in heat transfer relationship with said microwave energy converting means during said popping.

10. A package for shipping and microwave popping of popcorn, comprising:

(a) a predetermined quantity of popcorn kernels which will occupy a predictable volume when popped;

(b) a package containing said predetermined quantity of popcorn and, when used for popping corn, having a predetermined internal volume at least equal to said predictable volume occupied by said popcorn kernels when popped, said package having a wall having an interior surface, said wall adapted to rest in a generally flat horizontal configuration upon a horizontal support surface in a microwave oven; and (c) a microwave converting means connected with said package for converting microwave energy into heat for transfer in a sufficient amount to the popcorn kernels to reduce substantially the number of burned or unpopped kernels that could result if the kernels were popped solely by direct impingement of microwave energy, said microwave converting means including a microwave interactive material whose temperature increases in response to impinging microwaves, said microwave interactive material being supported by said wall and co-extensive with an area of said interior surface which is sufficiently large to permit said kernels to be sufficiently close to said interactive material during the popping process to receive enough heat from said interactive material to reduce substantially the number of burned or unpopped kernels.

11. A package as defined in claim 10, wherein the interior surface of said wall is large enough for said predetermined quantity of unpopped popcorn to be spread thereon in a configuration in which a majority of the kernels are generally within two layers when scattered during popping.

* * * * *

UNITED STATES PATENT AND TRADEMARK OFFICE

CERTIFICATE OF CORRECTION

PATENT NO. : 4,678,882
DATED : July 7, 1987
INVENTOR(S) : Timothy H. Bohrer et al.

It is certified that error appears in the above-identified patent and that said Letters Patent is hereby corrected as shown below:

Title page,
Item [*] Notice, delete "The portion of the term of this patent subsequent to Nov. 12, 2002 has been disclaimed." and insert -- This patent is subject to a terminal disclaimer. -- therefor.

Signed and Sealed this

Twenty-second Day of July, 2003

JAMES E. ROGAN
*Director of the United States Patent and Trademark Office*